US005427179A

United States Patent [19]

Bailey et al.

[11] Patent Number: 5,427,179

[45] Date of Patent: Jun. 27, 1995

[54] RETRIEVABLE WHIPSTOCK

[75] Inventors: Thomas F. Bailey; John E. Campbell; Larry F. Moeller, all of Houston, Tex.

[73] Assignee: Smith International, Inc., Houston, Tex.

[21] Appl. No.: 168,551

[22] Filed: Dec. 16, 1993

Related U.S. Application Data

[63] Continuation-in-part of Ser. No. 978,842, Nov. 19, 1992, Pat. No. 5,335,737.

[51] Int. Cl.[6] ..... E21B 7/08

[52] U.S. Cl. ..... 166/117.6; 175/81; 175/82

[58] Field of Search ..... 166/117.6; 175/81, 82, 175/80, 79, 83; 294/86.22

[56] References Cited

U.S. PATENT DOCUMENTS

| | | | |
|---|---|---|---|
| 1,524,265 | 1/1925 | Lester | 294/86.22 |
| 1,835,227 | 12/1931 | Lane et al. . | |
| 2,132,061 | 10/1938 | Walker | 166/117.6 |
| 2,207,920 | 7/1940 | Hughes | 175/82 X |
| 2,227,347 | 12/1940 | Johnson . | |
| 2,386,514 | 10/1945 | Stokes | 175/81 |
| 2,509,144 | 5/1950 | Grable et al. . | |
| 2,633,331 | 3/1953 | Hampton . | |
| 2,716,540 | 8/1955 | McCune et al. | 166/117.6 |
| 3,095,039 | 6/1963 | Kinzbach | 166/117.6 |
| 4,397,355 | 8/1982 | McLamore | 166/297 |
| 4,429,741 | 2/1984 | Hyland | 166/117.6 X |
| 4,765,404 | 8/1988 | Bailey et al. | 166/117.6 |
| 5,109,924 | 5/1992 | Jurgens et al. | 166/117.6 X |
| 5,154,231 | 10/1992 | Bailey et al. | 166/298 |
| 5,163,522 | 11/1992 | Eaton et al. | 166/117.6 X |

*Primary Examiner*—Hoang C. Dang
*Attorney, Agent, or Firm*—Robert M. Vargo

[57] ABSTRACT

A retrievable whipstock which can be hydraulically set within a wellbore and following the drilling procedure mechanically released and retrieved for future use. The whipstock includes a whip which directs a milling tool from the main well and a hydraulically actuated packer or anchor for setting the whipstock in the wellbore. The retrieval tool includes a nose piece to ensure proper orientation relative to the whipstock and a die collar to threadably engage the whip. An adapter on the retrieval tool wedges the whip away from the casing wall to ensure mating engagement between the retrieval tool and the whip. The whipstock is released through the application of tension through the retrieval tool allowing removal from the wellbore.

11 Claims, 4 Drawing Sheets

RETRIEVABLE WHIPSTOCK

This is a continuation-in-part of application Ser. No. 07/978,842 filed on Nov. 19, 1992, now the U.S. Pat. No. 5,335,737.

BACKGROUND OF THE INVENTION

I. Field of the Invention

This invention relates to whipstocks for diverting the direction of drilling in a wellbore and, in particular, to a retrieval tool for a retrievable whipstock which may be hydraulically set within the well and mechanically retrieved once the drilling procedure is completed.

II. Description of the Prior Art

As drilling procedures have become increasingly sophisticated, the drilling of wellbores which deviate from the vertical or main wellbore has become more critical. Such direction changes can be a result of a course correction or the desire to explore different stratas of the geological formation. It has long been recognized that the simplest method of altering the wellbore was by positively directing the drilling tool in an alternative direction using a whipstock. Early whipstocks were simply placed at the bottom of the main wellbore where subsequent drilling operations would be diverted along the whip face. These early whipstocks may also have been anchored mechanically to ensure proper orientation of the whip face. However, no attempts were made to retrieve these whipstocks and they were typically abandoned in the well. As technology improved it became desirable to set the whipstock in the wellbore at specific positions above the bottom of the hole. Separate packers were first positioned in the well and the whip speared into the set packer. One-trip whipstocks were later developed which allowed the whip to be hydraulically set within the well and the casing milled in a single trip of the drill string. However, much like the early whips, once the wellbore was deviated, the whipstock would be abandoned in the well.

SUMMARY OF THE PRESENT INVENTION

The present invention overcomes the disadvantages of the prior known whipstocks by providing a whipstock which may first be set within the wellbore using hydraulic fluid pressure supplied from the surface and, following the directional drilling procedure, mechanically released and retrieved from the wellbore for use in subsequent drilling operations.

The retrievable whipstock assembly of the present invention includes a whip incorporating a sloped surface for directing a milling tool out of the wellbore, means for setting the whip within the wellbore, such as an anchor or packer actuated by hydraulic pressure, and a retrieval tool for mechanically engaging and removing the whip from the well. In order to facilitate engagement of the whipstock by the retrieval tool, a die collar is incorporated into the retrieval tool which threadably engages the whip. The anchor/packer subassembly is released upon application of shear tension through the retrieval tool and the entire assembly retrieved from the well. The retrieval tool is provided with orientating means for ensuring proper mating engagement and removal of the tool.

In a preferred embodiment, the retrievable packer subassembly includes packing elements and a slip assembly to set the tool within the well. Hydraulic pressure through the tool acts on a piston to set the slip assembly and packing elements. A ratcheted lock nut maintains the packer in the set position and also acts as the shear-out mechanism for releasing the packer.

The retrieval tool includes an adapter sleeve to ensure proper orientation of the retrieval tool relative to the whip. Carried on the sleeve is a die collar for creating a threaded engagement with the whip to matingly connect the retrieval tool with the whipstock. The adapter extends from the nose of the sleeve and acts as a wedge to push the whip away from the wall of the casing ensuring mating engagement with the retrieval tool. Upon mating, threaded engagement, a predetermined tension can be applied through the drill string to release the packer sub-assembly for retrieval of the tool. Once at the surface, the retrieval tool can be disconnected from the whipstock allowing reuse of the whipstock assembly simply by unthreading the whip from the retrieval tool. Thus, the present invention provides a hydraulically set whipstock to ensure secure placement yet which can be mechanically released and retrieved from the well.

Other objects, features and advantages of the invention will be apparent from the following detailed description taken in connection with the accompanying drawings.

BRIEF DESCRIPTION OF THE DRAWING

The present invent ion will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
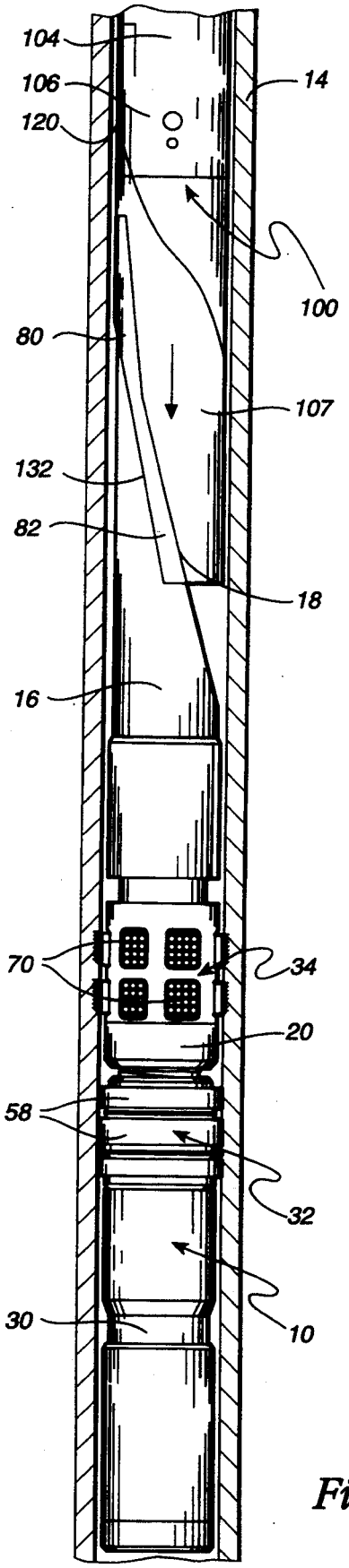
FIG. 1 is a positioned view of the retrievable whipstock of the present invention set within a wellbore and the retrieval tool for engaging the whipstock.
Figure 2:
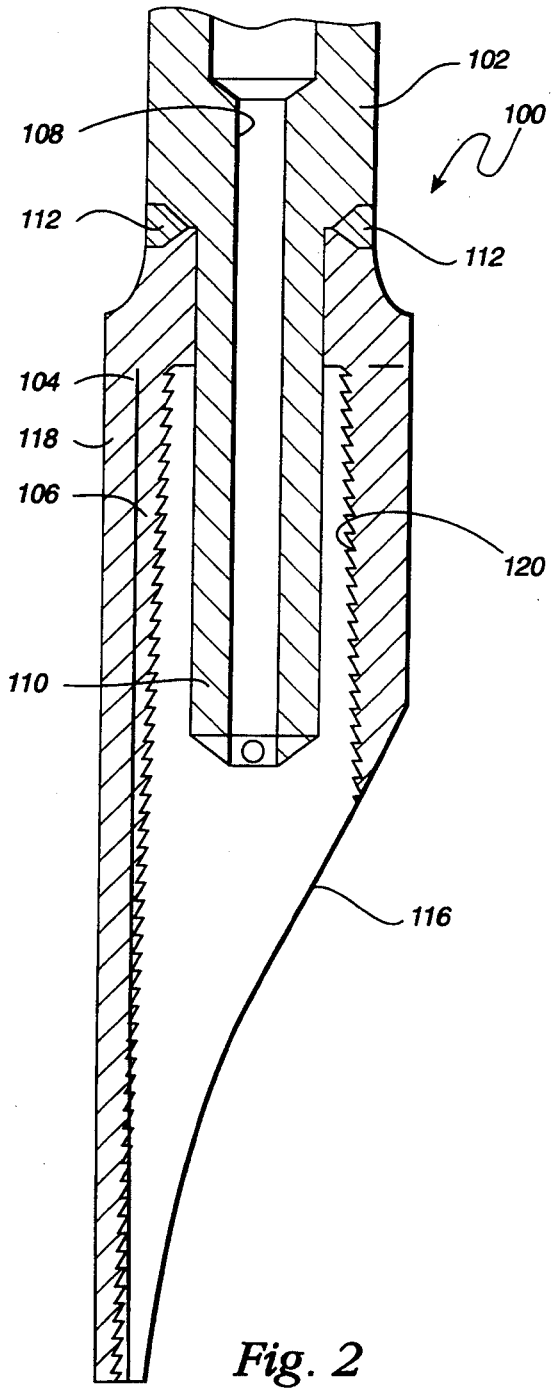
FIG. 2 is a partial cross-sectional view of the retrieval tool without an adapter.

Referring first to FIG. 1, there is shown a combination whipstock 10 and retrieval tool 100 in a cased wellbore 14 embodying the present invention. The whipstock 10 is designed to be hydraulically-set within the wellbore 14 using hydraulic fluid pressure supplied from the surface through a detachable running tool or milling tool (not shown) used to position the whipstock 10. Following secondary drilling operations using the whipstock 10, such as milling a window in the casing of the wellbore, the whipstock 10 may be mechanically released and retrieved from the wellbore 14 for reuse in subsequent drilling operations. Thus, the present invention incorporates the secure setting force of a hydraulically actuated whipstock 10 with a mechanical release for retrieval of the whipstock 10. The retrieval tool 100 is adapted to ensure secure mating engagement with the whipstock 10 allowing sufficient tension to be applied for release and retrieval.

Figure 3:
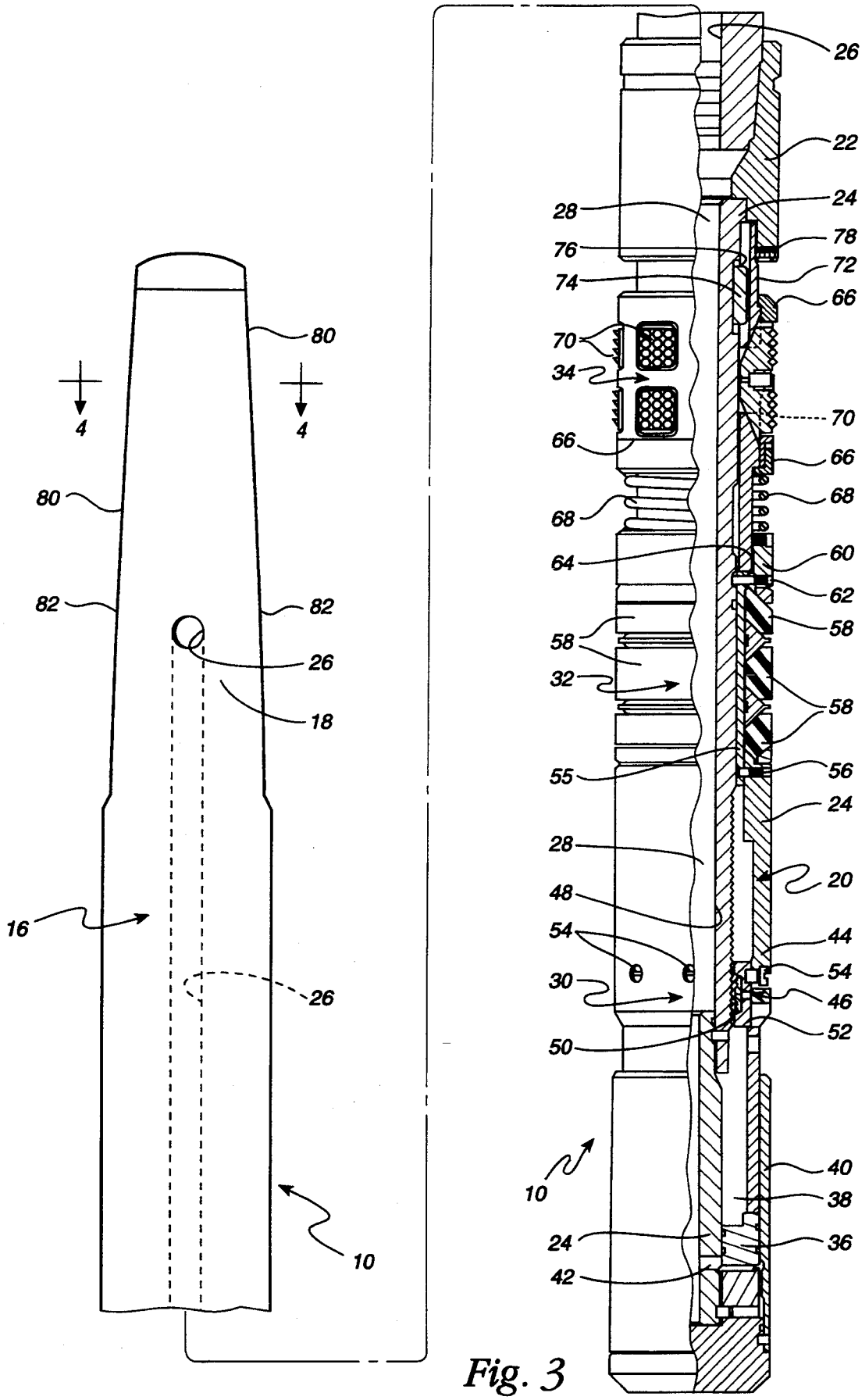
FIG. 3 is a partial cross-sectional view of the whipstock.
Figure 4:
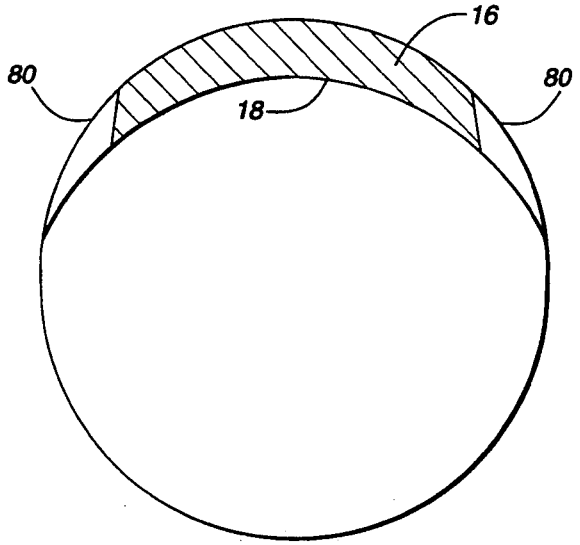
FIG. 4 is a lateral cross-section taken along lines 4—4 of FIG. 3.

Referring now to FIGS. 1 and 3, the whipstock 10 includes a whip 16 having a whip face 18 for diverting a milling tool from the wellbore 14 and means attached to the whip 16 for setting the whipstock 10 at the desired position within the wellbore 14. In a preferred embodiment of the present invention, the setting means comprises a packer 20 although it is to be understood that a non-sealing anchor may be substituted therefor for securing the whipstock 10 within the wellbore 14. The whip 16 is typically connected to the packer 20 through a threaded sub 22 which is connected to an inner mandrel 24 of the packer 20. A fluid passageway 26 in the whip 16 communicates with an inner passageway 28 of the mandrel 24 through which hydraulic fluid pressure is supplied from the surface for setting the packer 20 as will be subsequently described.

The setting assembly of the packer 20 is mounted to the mandrel 24 and generally includes a setting/locking assembly 30, a packer assembly 32 and a slip assembly 34. The setting/locking assembly 30 includes a piston 36 which is slidably disposed within a cylinder 38 formed by the mandrel 24 and an outer wall 40. The cylinder 38 communicates with the inner passageway 28 through ports 42 such that the hydraulic fluid pressure will act on the piston 36 moving it longitudinally within the cylinder 38. The piston 36 in turn acts upon a lower packer retainer 44 which also carries the locking mechanism 46. The inner mandrel 24 in the vicinity of the locking mechanism 46 is provided with an outer ratchet surface 48 adapted to lockingly engage a ratchet surface of a locking nut 50 of the locking mechanism 46. The locking nut 50 is detachably connected to the lower packer retainer wall 44 by a locking nut holder 52 and a series of release shear screws 54. Thus, as the piston 36 moves within the cylinder 38 as a result of increased hydraulic pressure, the retainer wall 44 will similarly be affected moving the locking nut 50 along the ratchet surface 48 of the mandrel 24.

The lower packer retainer wall 44 is detachably connected to a mandrel sleeve 55 by lower shear screws 56. The mandrel sleeve 55 extends beneath the packing elements 58 and is detachably connected to upper retainer 60 by upper shear screws 62. The lower and upper retainers 44, 60 are designed to compress the packing elements 58 into sealing engagement with the wellbore wall 14 as will be described in conjunction with operation of the packer 20.

The upper retainer 60 is connected to a lower slip cone 64 of the slip assembly 34. A slip body 66 coaxially mounted to the lower slip cone 64 retains a spring 68 adapted to facilitate even setting of the slip assembly 34 against the wellbore wall 14. A plurality of slip elements 70 adapted to selectively engage the casing 14 are retained within the slip body 66. An upper slip cone 72 is connected to the mandrel 24 by a key 74 which is received in a slot 76 of the mandrel 24 and to the sub 22 by set screws 78. The lower and upper slip cones 64, 72 drive the slip elements 70 radially outwardly into engagement with the wall 14 upon setting of the packer as will be subsequently described.

The whip 16 attached to the packer 20 and in addition to the inclined whipface 18 also includes side edges 82 of the whipface 18 proximate the upper end of the whipstock. The side edges 82 facilitates mating engagement with the retrieval tool 100 and subsequent retrieval of the whipstock 10.

Figure 5:
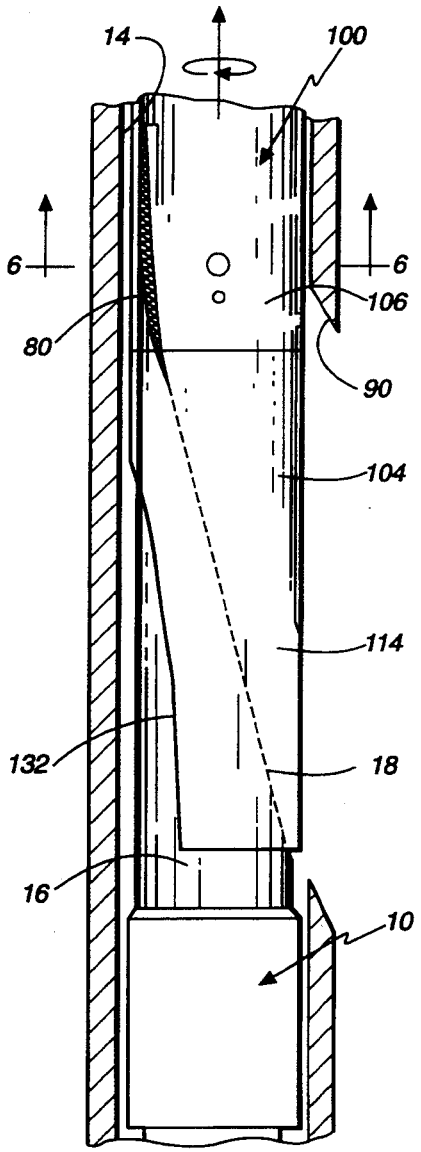
FIG. 5 is an enlarged perspective view of the retrieval tool matingly engaging the retrievable whipstock.
Figure 6:
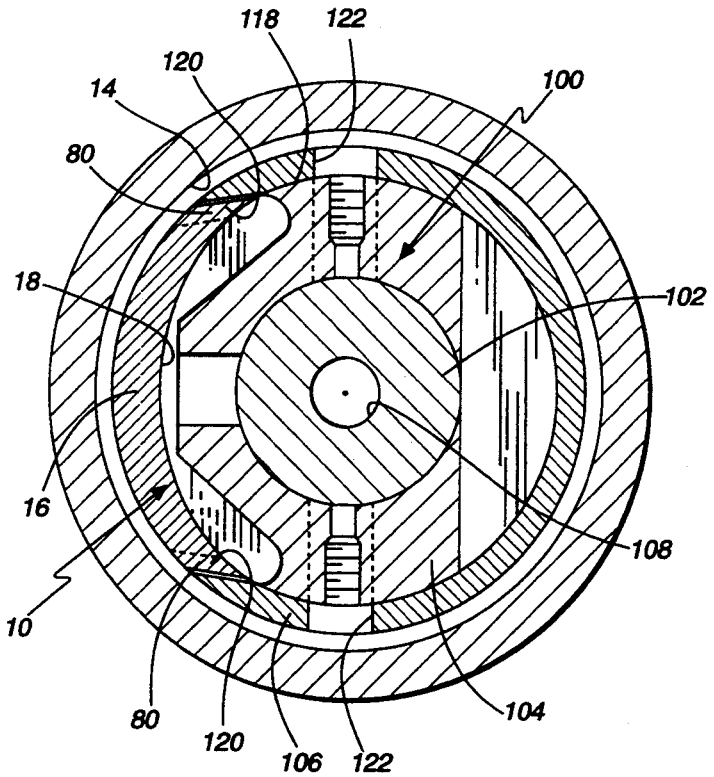
FIG. 6 is a lateral cross-section taken along lines 6—6 of FIG. 5.

Referring now to FIGS. 1 through 4, the retrieval tool 100 comprises four primary components: a mandrel 102, a sleeve 104 coaxially mounted to the mandrel 102, a die collar 106 mounted to the sleeve 104 and an adapter 107 extending from the sleeve 104. The mandrel 102 is preferably connected at its upper end to a well string and includes a central fluid passageway 108 with nozzles 110 at its lower end. The passageway 108 and nozzles 110 facilitate introduction of fluid to wash away any debris which may impede proper engagement of the retrieval tool 100 with the whipstock 10. The sleeve 104 is coaxially mounted to the mandrel 102 by weld 112. As best shown in FIG. 5, the sleeve 104 has a tapered configuration which forms an orientation nose 114. The sloped face 116 of the sleeve 104 also aids in orientating the retrieval tool 100 relative to the whipstock 10 by matingly engaging the face 18 of the whip 16. A reduced diameter neck portion 118 of the sleeve 104 includes a die collar 106 which will form a threaded engagement with any tool inserted therein. The die collar 106 has inner thread formers 120 designed to threadably engage the edges 82 of the whip 16.

Figure 7:
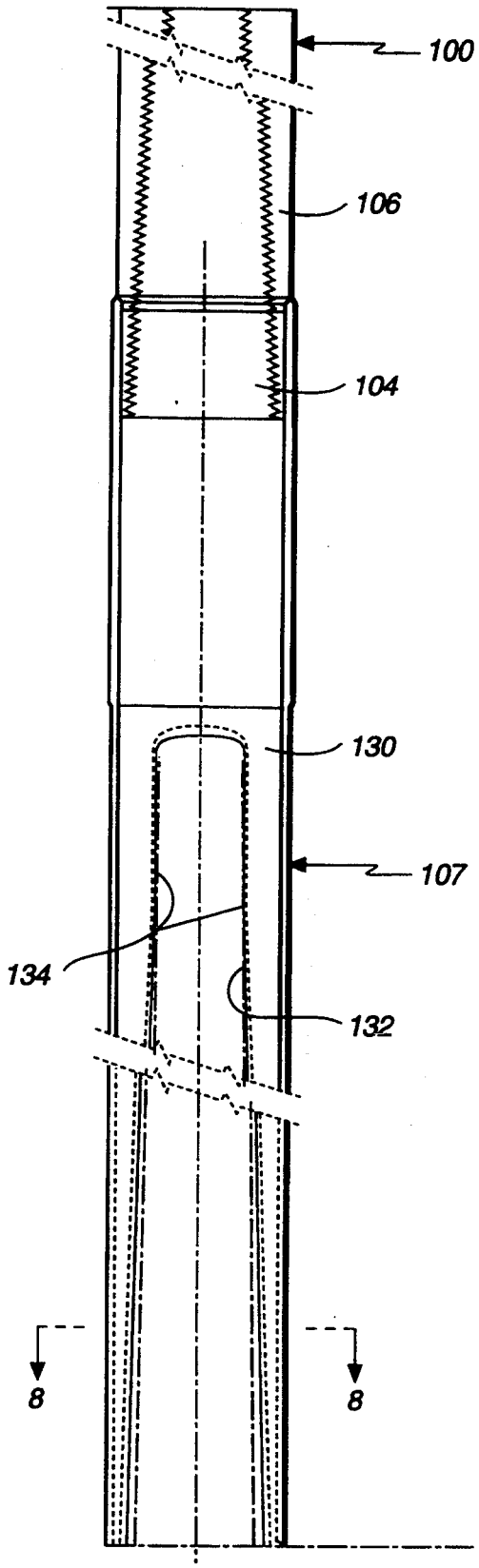
FIG. 7 is a cross-sectional view of an alternative embodiment of the retrieval tool.
Figure 8:
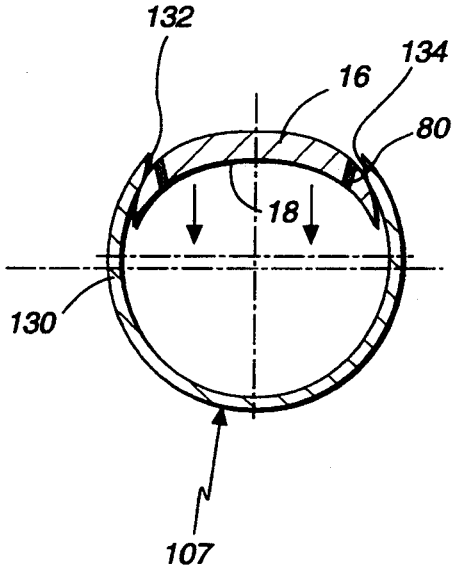
FIG. 8 is a lateral cross-section taken along lines 8—8 of FIG. 7.

In many cases, the whip 16 engages the wall of the casing so as to deter the mating engagement of the retrieval tool 100 with the whip 16. Upon deployment of the retrieval tool 100, the mandrel 102 may butt against the top of the whip 16 causing it to be turned out of alignment or simply preventing further travel of theretrieval tool 100. The adapter 107 of the retrieval tool 100 gradually extends between the whip 16 and the casing or wall of the wellbore facilitating mating engagement. The adapter 107 has a substantially tubular body 130 and is attached to the downhole end of the sleeve 104. The tubular adapter 107 includes a longitudinal cut-out 132 open to the bottom of the adapter 107 and having a gradually narrowing tapered configuration. As best shown in FIG. 7, the edges 134 of the cut-out 132 are tapered along their entire length acting as wedges to move the whip 16 away from the casing wall. In addition, the end edge 136 of the cut-out 132 is similarly tapered to force the whip 16 into the sleeve 104 for proper orientation with the die collar 106 and subsequent retrieval of the whipstock 10.

Operation of the whipstock system of the present invention allows secure hydraulic setting of the whipstock 10 within the wellbore 14 and subsequent mechanical release and retrieval using the retrieval tool 100. The whipstock 10 is run into the wellbore 14 to the desired position using a simple running tool or a combination running tool and mill detachably connected to a whipstock 10. A fluid supply line from the surface through the running tool communicates with the passageways 26 and 28 to supply hydraulic fluid pressure to the packer 20. Once positioned, fluid pressure is increased through the inner passageway 28 which supplies fluid through the ports 42 into the cylinder 38. The hydraulic fluid pressure acts on the piston 36 which pushes against the lower retainer wall 44. As the lower retainer wall 44 moves longitudinally, the locking nut 50 moves along the ratchet surface 48 preventing movement of the lower retainer wall 44 in the opposite or downward direction. As the lower retainer wall 44 moves upwardly mandrel sleeve 55 will move upwardly which in turn acts upon the lower slip cone 64 and the upper retainer 60. Upon sufficient force, the upper shear screws 62 will first shear releasing the mandrel sleeve 55 from the mandrel 24. As the lower slip cone 64 moves towards the upper slip cone 72, which is fixed against movement, the slip elements 70 will be moved out against the wellbore wall 14. As the slip assembly 34 is set and additional force is applied to the lower retainer wall 44, the lower screws 56 will shear disconnecting the lower retainer wall 44 from the mandrel sleeve 55. Once released, the lower retainer wall 44 will compress the packing elements 58 into sealing engagement with the wellbore 14. When both the packing assembly 32 and the slip assembly 34 are fully set the lower retainer wall 44 will have moved the locking mechanism 46 along the ratchet surface 48 preventing downward movement of the lower retainer wall 44 and therefore release of the packer 20.

With the whipstock 10 set in the wellbore 14 the secondary drilling operation can be conducted. Examples of how the whipstock 10 may be used include milling a window 90 in the casing 14 for diverted drilling operations or simply diverting the direction of drilling from the main wellbore 14. As has been noted, the mill may have been tripped into the wellbore along with the whipstock 10 or the whipstock 10 may have been set using a running tool which is tripped out of the hole and followed by a secondary drilling tool.

Once the drilling operation is completed and it is desired to retrieve the whipstock 10, the retrieval tool 100 is tripped into the wellbore 14 for mating engagement with the whipstock 10. The retrieval tool 100 is self-orientating to ensure proper engagement. The opposing tapered edges 134 will wedge behind the whip 16 forcing it gradually away from the casing wall and eventually into mating engagement with the sleeve 104 and the die collar 106.

In addition, the nozzles 110 can be used to wash away mud and debris which may block access to the whipstock 10. In the event the die collar 106 is not in alignment with the edges of 82 of the whip 16, the nose 114 of the retrieval tool 100 cause the tool to rotate into proper alignment. The tapered configuration of the nose 114 will cause the retrieval tool 100 to rotate in one direction or the other. The sloped surfaces of the whip face 18 and the sleeve 104 will continue this rotation. As the retrieval tool 100 continues to be lowered the die collar 82 lockingly engages the retrieval tool to the whipstock 10.

With the whipstock 10 set in the wellbore 14, upward tension applied through the retrieval tool 100 will be transmitted through the whip 16 to the upper sub 22 of the packer 20. As this tension is applied to the sub 22, the upper slip cone 72 connected thereto will be immediately drawn upwardly transmitting the tension to the mandrel 24 through the key 74. Although the upper slip cone 72 has been partially withdrawn from beneath the slip elements 70, the slip assembly 34 will remain set. The tension applied to the mandrel 24 will be transmitted to the locking mechanism 46 through the engaged ratchets. As a threshold tension is reached the screws 54 will shear releasing the locking nut 50 and the nut holder 52 from the lower retainer wall 44. Consequently, the lower retainer wall 44 will move downwardly releasing the compression of the packing elements 58. Continued upward tension will draw the upper slip cone 72 and slip body 66 upwardly moving the slip elements 70 off of the lower slip cone 64 to retract the slip assembly 34. With both the packer assembly 32 and the slip assembly 34 retracted, the whipstock 10 is again free within the wellbore 14.

Retrieval of the whipstock 10 now simply requires tripping the entire assembly out of the wellbore 14. Once at the surface, the retrieval tool 100 can be detached from the whipstock 10 by rotating the whip relating to the retrieval tool 100 and remove the whipstock 10. The whipstock 10 can be reused following replacement of the shear screws and resetting of the locking mechanism. Thus, the present invention provides a retrievable whipstock which is hydraulically-set within the wellbore and subsequently mechanically released for retrieval from the well.

The foregoing detailed description has been given for clearness of understanding only and no unnecessary limitations should be understood therefrom as some modifications will be obvious to those skilled in the art without departing from the scope and spirit of the appended claims.

What is claimed is:

1. A whipstock system for changing the direction of drilling within a wellbore comprising:

a whip for diverting the direction of drilling;

means for setting said whipstock within the wellbore, said means attached to said whip such that said whip and setting means are run into the wellbore in a single trip, said setting means being actuated for setting said whipstock within the wellbore; and means for mechanically dislodging said setting means to retrieve said whipstock from the wellbore comprising a retrieval tool which matingly engages said whip for retrieval of said whipstock, said retrieval tool comprising a die collar to threadably, engage the whip whereby tension applied through said retrieval tool is transmitted to said whipstock to mechanically dislodge said setting means.

2. The whipstock system as defined in claim 1 wherein said setting means comprises a packer having at least one packing element movable into sealing engagement with the wellbore wall and at least on slip element engageable with the wellbore wall.

3. The whipstock system as defined in claim 1 wherein said setting means comprises an anchor having at least one slip element movable into non-sealing engagement with the wellbore wall.

4. The whipstock system as defined in claim 1 wherein said retrieval tool includes an inner mandrel, a sleeve mounted to said inner mandrel, and a die collar mounted to said sleeve for selective locking engagement with said whip.

5. The whipstock system as defined in claim 4 wherein said die collar includes thread formers for threadably deforming said whip to lockingly engage said whipstock.

6. The whipstock system as defined in claim 4 wherein said retrieval tool includes a nose for orientating said retrieval tool relative to said whip for locking engagement of said whipstock to said retrieval tool.

7. The whipstock system as defined in claim 4 and further comprising an adapter extending from said sleeve and having an inner passageway for guiding said whip into mating engagement with said sleeve.

8. The whipstock system as defined in claim 7 wherein said adapter includes a cut-out notch formed in a wall of said adapter, said cut-out having opposing edges selectively engageable with said whip.

9. The whipstock system as defined in claim 8 wherein said opposing edges are tapered to wedge said whip away from the wall of the wellbore.

10. A retrievable whipstock system for changing the direction of drilling within a wellbore comprising:

a whip for diverting the direction of drilling;

means for setting said whipstock within the wellbore, said means attached to said whip such that said whip and setting means are run into the wellbore in a single trip, said setting means being hydraulically actuated to secure said whipstock within the wellbore; and a retrieval tool having a die collar therewithin for mechanically dislodging said setting means to retrieve said whipstock from the wellbore, said whip comprising side edges selectively and threadably engageable with the die collar within said retrieval tool upon mating engagement of said retrieval tool with said whip in order to apply mechanical tension for retrieving said whipstock.

11. The whipstock system as defined in claim 10 and further comprising an adapter extending from said retrieval tool and having an inner passageway for guiding said whip into mating engagement with said retrieval tool, said adapter including a cut-out notch formed in a wall of said adapter, said cut-out having opposing edges selectively engageable with said whip to gradually force said whip from the wellbore wall.

* * * * *